US008326497B2

(12) United States Patent
Shahidi et al.

(10) Patent No.: US 8,326,497 B2
(45) **Date of Patent: *Dec. 4, 2012**

(54) VEHICLE DOOR CLOSE/OPEN ASSIST AND ANTI-SLAM DEVICE

(75) Inventors: Bijan K. Shahidi, Novi, MI (US); XianLi Huang, Northville, MI (US); Zhen Steven Zhang, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 775 days.

This patent is subject to a terminal disclaimer.

(21) Appl. No.: 12/352,078

(22) Filed: Jan. 12, 2009

(65) Prior Publication Data

US 2010/0179732 A1 Jul. 15, 2010

(51) Int. Cl.
*E05C 17/56* (2006.01)

(52) U.S. Cl. ..... 701/49; 701/36; 296/146.9

(58) Field of Classification Search ..... 701/49, 701/36; 49/478.1; 296/146.1, 146.4, 146.9, 296/207; 292/251.5

See application file for complete search history.

(56) References Cited

U.S. PATENT DOCUMENTS

| | | | | |
|---|---|---|---|---|
| 3,427,832 | A * | 2/1969 | Planer | 70/264 |
| 4,674,230 | A * | 6/1987 | Takeo et al. | 49/32 |
| 4,689,849 | A * | 9/1987 | Eger et al. | 16/82 |
| 5,170,530 | A | 12/1992 | Kopec et al. | |
| 5,171,048 | A | 12/1992 | Weinerman et al. | |
| 5,468,042 | A * | 11/1995 | Heinrichs et al. | 296/146.4 |
| 5,517,719 | A | 5/1996 | Christ | |
| 5,549,348 | A | 8/1996 | Posa | |
| 5,746,459 | A | 5/1998 | Giroux, Jr. et al. | |
| 5,862,692 | A | 1/1999 | Legault et al. | |
| RE36,427 | E * | 12/1999 | Gioutsos | 280/735 |
| 6,203,060 | B1 * | 3/2001 | Cech et al. | 280/735 |
| 6,283,534 | B1 * | 9/2001 | Mrozowski et al. | 296/146.2 |
| 6,290,283 | B1 * | 9/2001 | Fukumoto et al. | 296/155 |
| 6,305,727 | B1 | 10/2001 | Bland | |
| 6,317,922 | B1 | 11/2001 | Kondratuk | |
| 6,540,270 | B1 | 4/2003 | Reddmann | |
| 6,557,209 | B1 | 5/2003 | Wood et al. | |
| 6,733,066 | B1 | 5/2004 | Valdez | |
| 6,758,012 | B2 | 7/2004 | Shimizu | |
| 6,866,328 | B1 | 3/2005 | Mustybrook | |
| 7,261,338 | B2 * | 8/2007 | Spurr | 292/216 |
| 7,406,377 | B2 * | 7/2008 | Shiga | 701/49 |

(Continued)

FOREIGN PATENT DOCUMENTS

DE 202006012387 * 12/2006

*Primary Examiner* — Paul N Dickson
*Assistant Examiner* — Timothy Wilhelm
(74) *Attorney, Agent, or Firm* — James J. Dottavio; Price Heneveld LLP

(57) ABSTRACT

A vehicle door actuating device for a vehicle includes an actuator device disposed on one of a vehicle door and a door frame of the vehicle. A bumper is disposed on the other of the vehicle door and the door frame opposite the actuator device. A door sensor is disposed on the vehicle that measures door position and door movement. A controller receives data from the door sensor relating to the door position and door movement and activates the actuator device when the vehicle is in a parked position. The controller instructs the actuator device to repel the bumper to assist a user in opening the vehicle door and attract the bumper to assist a user in closing the vehicle door during closure.

17 Claims, 4 Drawing Sheets

U.S. PATENT DOCUMENTS

2002/0189168 A1* 12/2002 Sicuranza ..... 49/26
2004/0124662 A1* 7/2004 Cleland et al. ..... 296/146.4
2005/0082870 A1 4/2005 Chikata et al.
2005/0198774 A1* 9/2005 Henry et al. ..... 16/71
2006/0242908 A1* 11/2006 McKinney ..... 49/280
2007/0018790 A1* 1/2007 LaFrance ..... 340/5.72
2008/0296929 A1* 12/2008 Suzuki et al. ..... 296/146.9
2009/0043456 A1* 2/2009 Shahidi et al. ..... 701/49
2009/0217596 A1* 9/2009 Neundorf et al. ..... 49/506

* cited by examiner

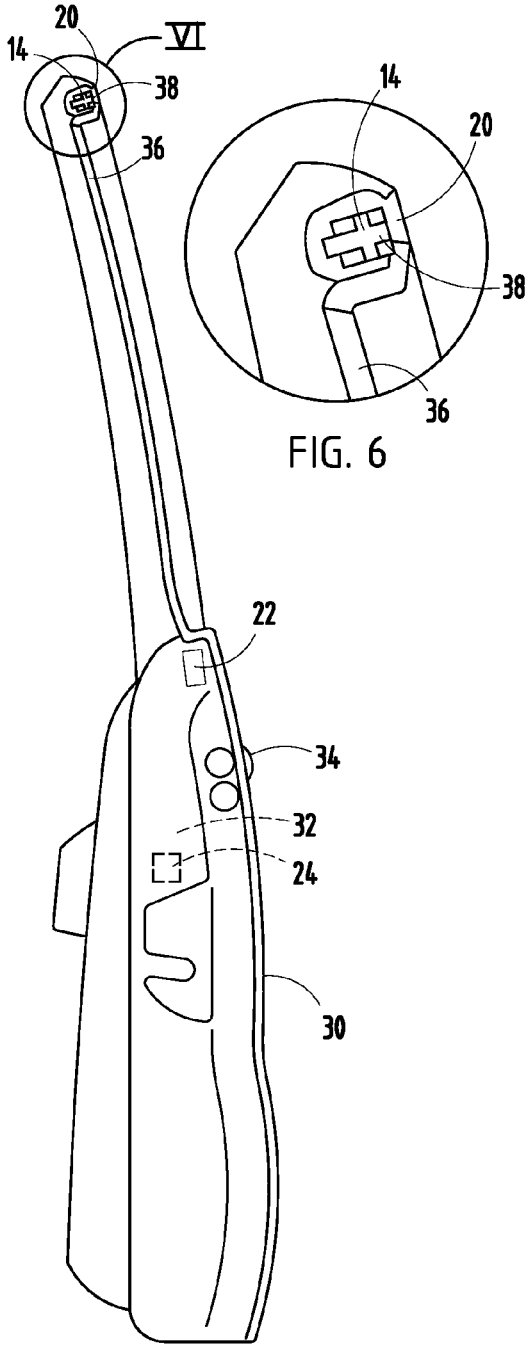
FIG. 6
FIG. 5
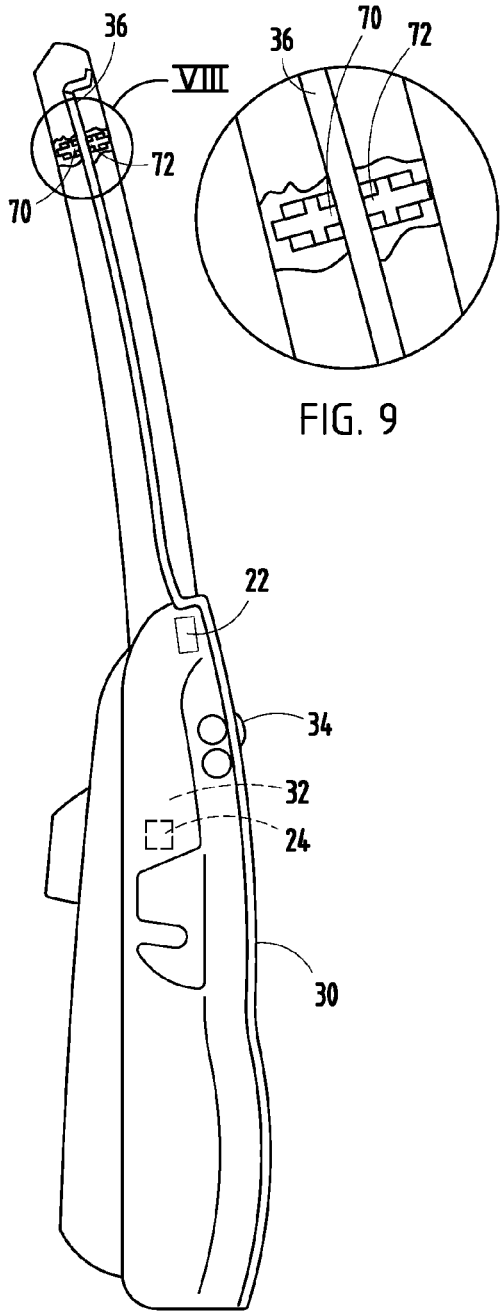
FIG. 9
FIG. 8

VEHICLE DOOR CLOSE/OPEN ASSIST AND ANTI-SLAM DEVICE

FIELD OF THE INVENTION

The present invention generally relates to an open/close door actuator, and more specifically, to an actuator that assists a vehicle user in opening the door, closing the door, and preventing the door from slamming.

BACKGROUND OF THE PRESENT INVENTION

Vehicle doors are oftentimes heavy to promote safety and security of individuals inside the vehicle. Opening and closing heavy doors can be difficult for young people as well as elderly people.

SUMMARY OF THE INVENTION

In one aspect of the present invention, a vehicle door actuating device for a vehicle includes a first actuator device disposed on one of a vehicle door and a door frame of the vehicle. A first bumper is disposed on the other of the vehicle door and the door frame opposite the first actuator device. A door sensor is disposed on the vehicle that measures door position and door movement. A controller receives data from the door sensor relating to the door position and door movement and activates the first actuator device when the vehicle is in a parked position. The controller instructs the first actuator device to repel the bumper to assist a user in opening the vehicle door and attract the bumper to assist a user in closing the vehicle door during closure.

In another aspect of the present invention, a vehicle door actuating device for a vehicle includes a first actuator device disposed on one of the vehicle door and the vehicle frame. A second actuator device is disposed on the other of the vehicle door and the vehicle frame opposite the first electromagnetic device. A door sensor is disposed on the vehicle that provides data relating to door position and movement of the door relative to the vehicle. A controller is connected to the first actuator device and activates the first actuator device when the vehicle is in a parked position, wherein the controller instructs the first actuator device to repel the second actuator device to assist a user in opening the door and attract the second actuator device to assist a user in closing the door during closure.

In another aspect of the present invention, a method for controlling the opening and closing of a vehicle door includes a step of providing an actuator device on one of the vehicle door and a vehicle frame. A door sensor is connected to the vehicle door. The position and velocity of the door is measured relative to the vehicle frame. A controller is connected to the door sensor that instructs the first actuator device to repel the door to assist a user in opening the door and attract the door to assist a user in closing the door during closure.

These and other features, advantages, and objects of the present invention will be further understood and appreciated by those skilled in the art upon studying the following specification, claims, and appended drawings.

BRIEF DESCRIPTION OF THE DRAWINGS

FIG. 5 is rear elevational view of the door of FIG. 3;

FIG. 6 is an enlarged view of area VI of FIG. 5;

FIG. 8 is a rear elevational view of the door of FIG. 3 with another embodiment of a door actuator device disposed therein; and FIG. 9 is an enlarged view of area VIII of FIG. 8.

DETAILED DESCRIPTION OF EMBODIMENT

Figure 1:
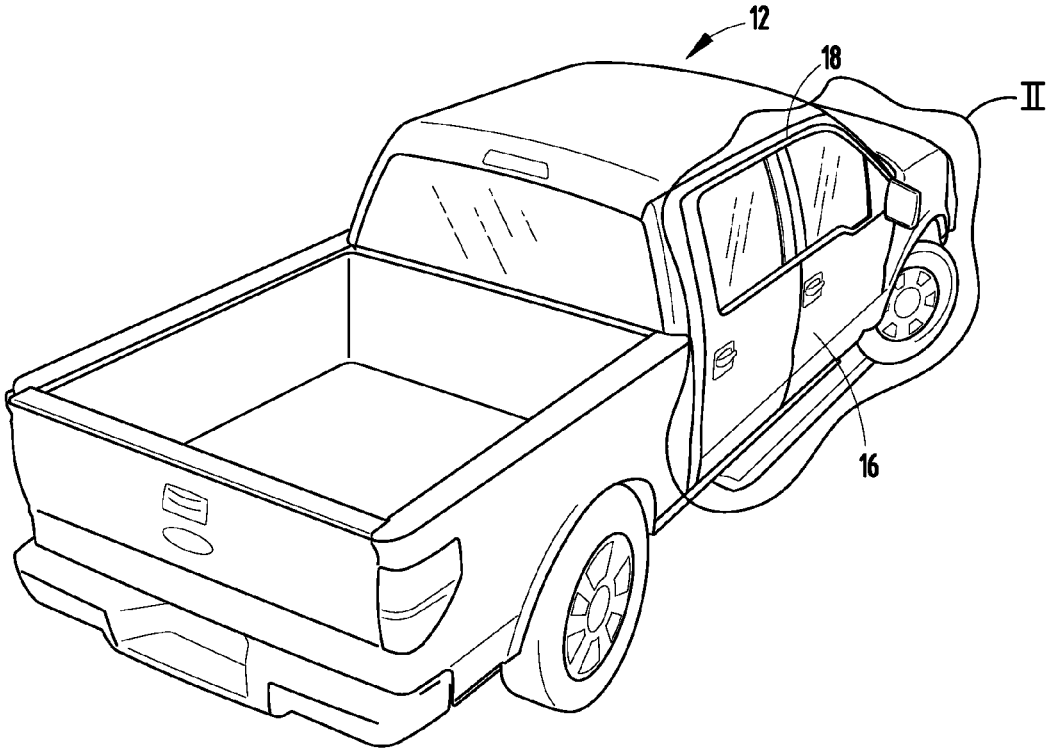
FIG. 1 is a top perspective view of a vehicle that includes one embodiment of the present invention.
Figure 2:
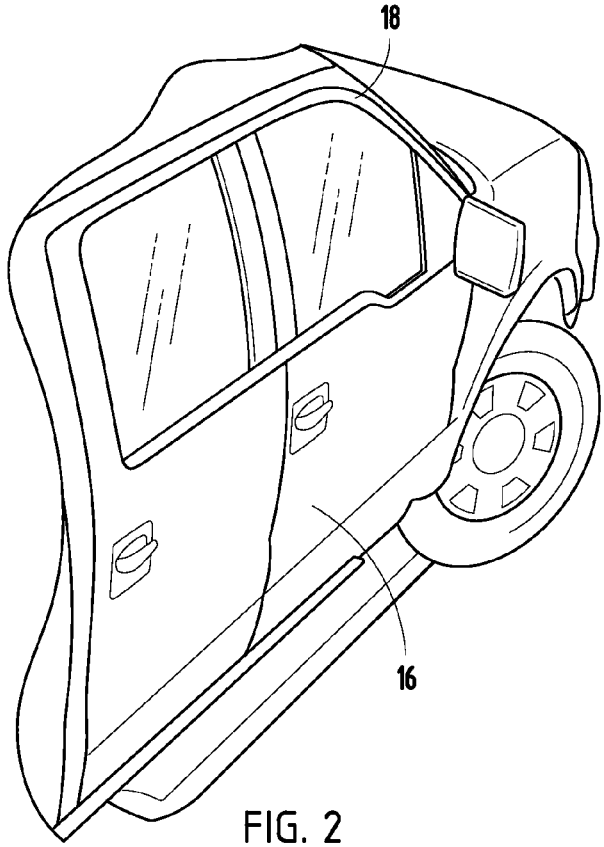
FIG. 2 is top perspective view of a vehicle door that includes the actuator device of the present invention.

For purposes of description herein the terms "upper," "lower," "right," "left," "rear," "front," "vertical," "horizontal" and derivatives thereof shall relate generally to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIGS. 1-4, the reference numeral 10 generally designates a vehicle door actuating device for a vehicle 12 that includes an actuator device 14 disposed on one of a vehicle door 16 and a door frame 18 of the vehicle 12. A bumper 20 is disposed on the other of the vehicle door 16 and the door frame 18 opposite the actuator device 14. A door sensor 22 is disposed on the vehicle 12 that measures door position and door movement. A controller 24 receives data from the door sensor 22 relating to the door position and door movement and activates the actuator device 14 when the vehicle 12 is in a parked position. The controller 24 instructs the actuator device 14 to repel the bumper 20 to assist a user in opening the vehicle door 16 and attract the bumper 20 to assist a user in closing the vehicle door 16 during closure.

Figure 3:
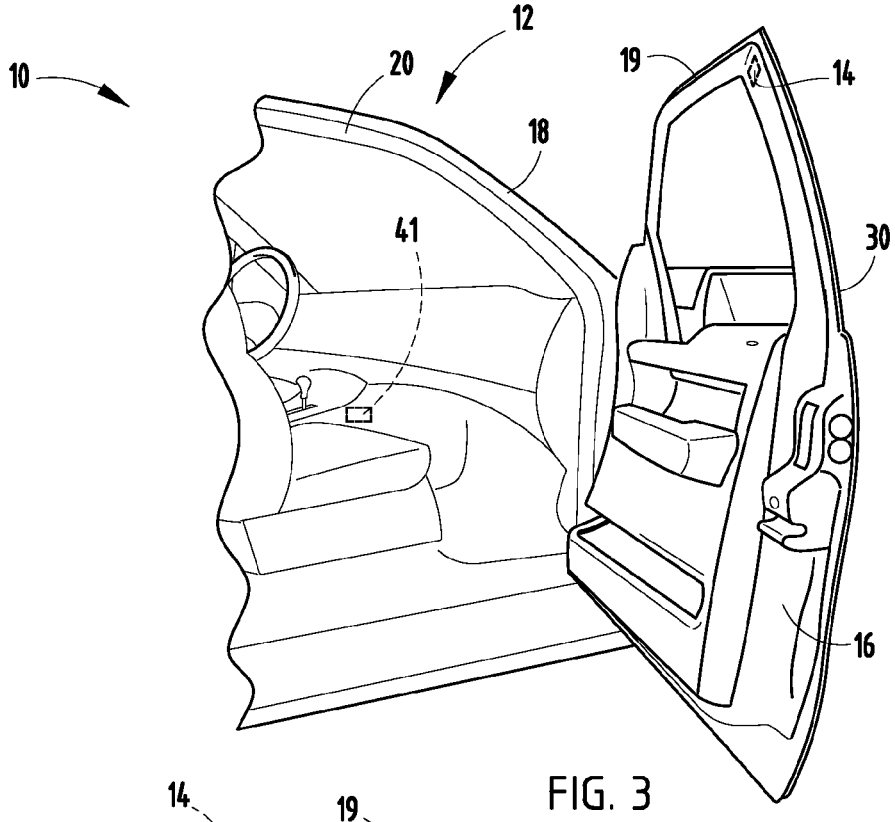
FIG. 3 is a side perspective view of an open vehicle door of the present invention.
Figure 4:
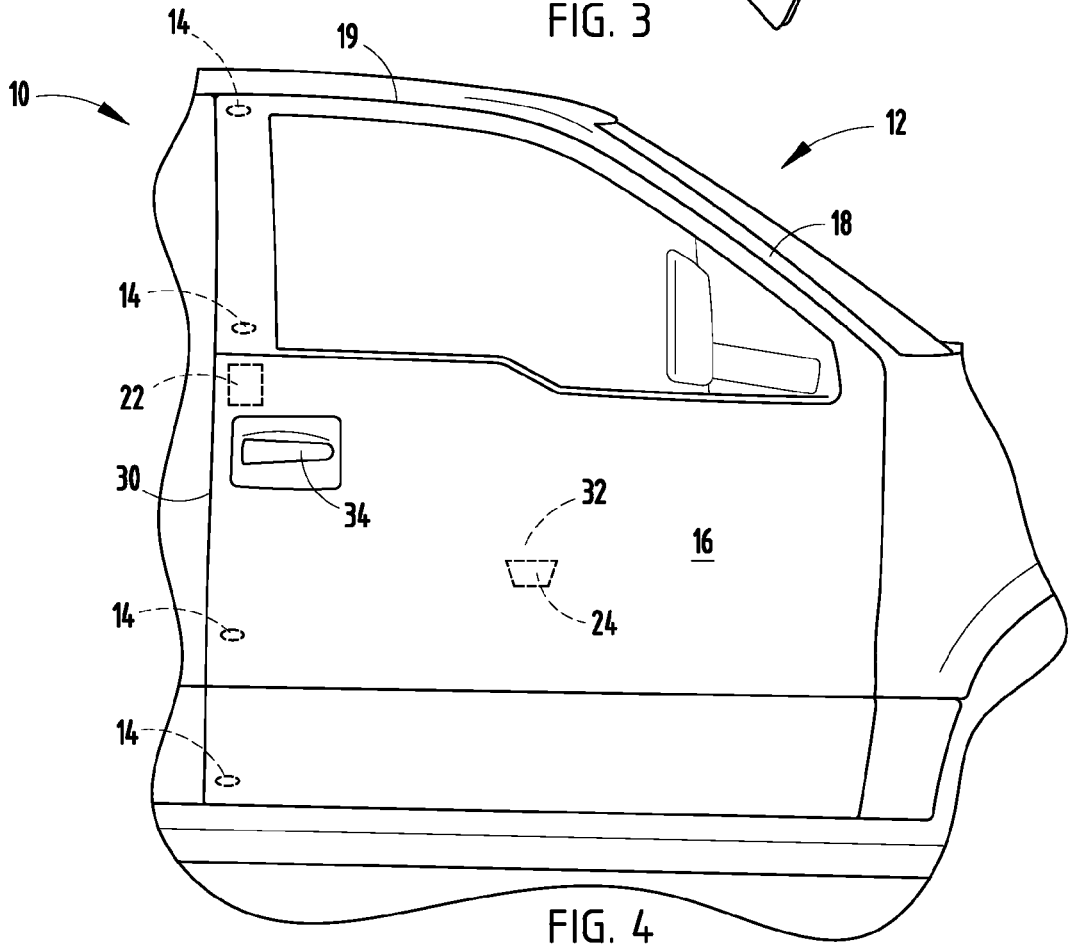
FIG. 4 is side elevational view of the door of FIG. 3 closed.

Referring now to FIGS. 3 and 4, the actuator device 14 may be disposed anywhere along the door frame 18 or door edge 19, however, the actuator device 14 will generally be positioned along a rear edge 30 of the vehicle door 16. The embodiment illustrated in FIG. 4 shows four actuator devices 14 disposed along the rear edge 30 of the vehicle door 16 although it is contemplated that varying numbers of actuator devices 14 may be utilized. In addition, the controller 24 is positioned at a central portion 32 of the vehicle door 16 and the door sensor 22 is positioned adjacent a door handle 34. It will be understood by one having ordinary skill in the art that the controller 24 may be positioned anywhere in the vehicle 12.

Referring now to the embodiment illustrated in FIGS. 5 and 6, the actuator device 14 is positioned at a top portion 36 of the rear edge 30 of the vehicle door 16. The actuator device 14 includes an engagement end 38 that abuts the bumper 20 on the door frame 18 of the vehicle 12 (FIG. 3). The bumper 20 is constructed of a pliable material such as rubber or soft plastic and also includes a magnetic material to maintain a tight seal with the vehicle door 16 when the vehicle door 16 is closed. The door sensor 22 is disposed below the actuator device 14 and measures the position of the vehicle door 16 as well as velocity of the vehicle door 16 during movement, as will be discussed in further detail below.

Figure 7:
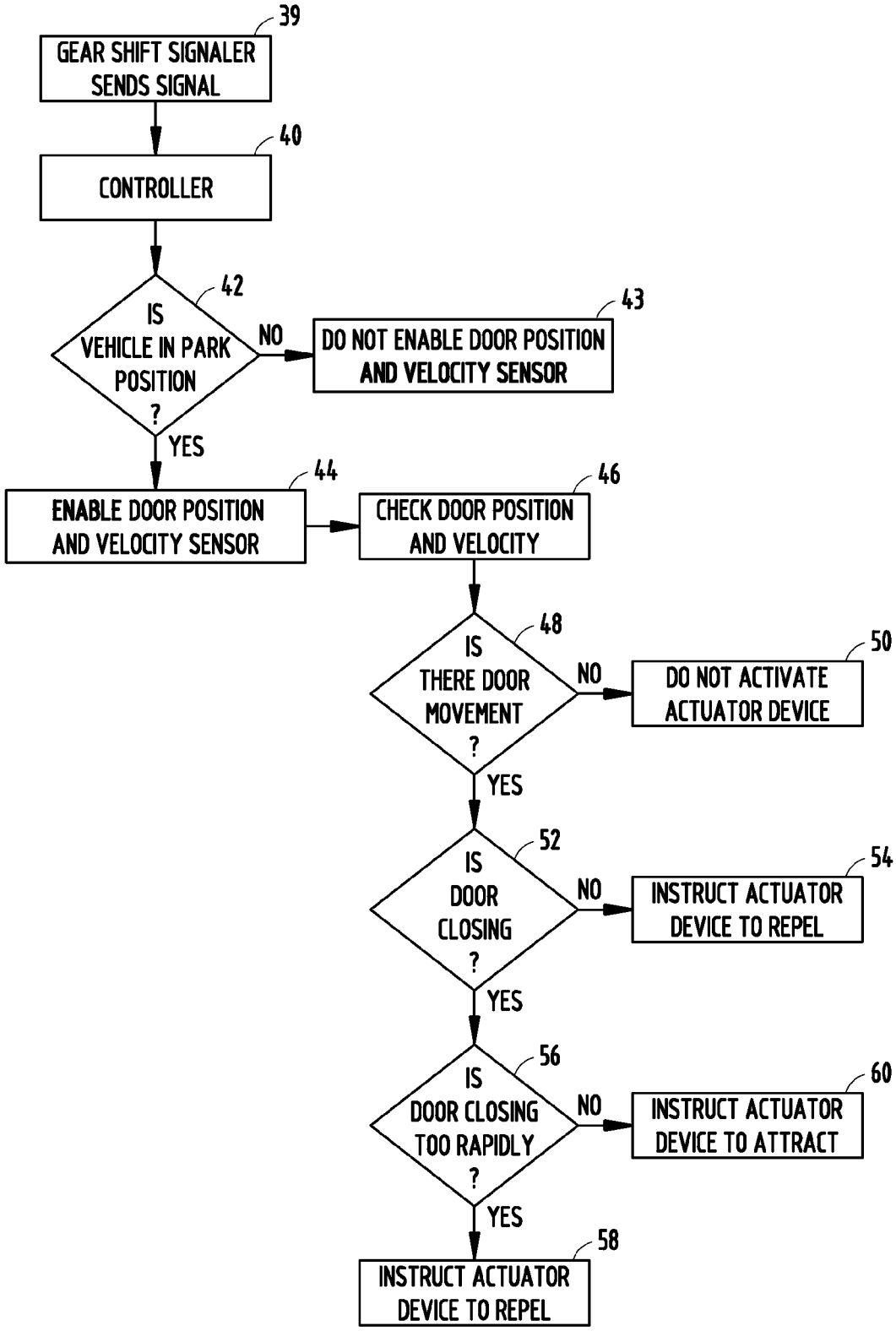
FIG. 7 is a flow chart illustrating the logic of one embodiment of the open/close device system of the present invention.

FIG. 7 shows one embodiment of the general operation of the door actuating device 10. In step 39, a gearshift signaler 41 checks the gear selection of the vehicle 12. In step 40, the controller 24 receives information from the gearshift signaler 41 indicating whether the vehicle 12 is in a parked position. In step 42, if the vehicle 12 is not in a parked position, then the vehicle door sensor 22 is not enabled (step 43). Alternatively, if the vehicle 12 is in the parked position as shown in step 44, then the door sensor 22 is enabled. In step 46, the sensor 22 checks the vehicle door position and velocity and sends position and velocity information to the controller 24 regarding the vehicle door 16. In step 48, if the vehicle door 16 is not moving, then the actuator device 14 is not activated (step 50). If the vehicle door 16 is moving, then the door sensor 22 provides information to the controller 24 regarding whether the vehicle door 16 is opening or closing (step 52). If the vehicle door 16 is opening, then the controller 24 instructs the actuator device 24 to repel (step 54).

If the vehicle door 16 is closing (step 56), then the door sensor 22 assesses the rate of closure. If the vehicle door 16 is closing too fast based on given predetermined parameters set inside the controller 24, then the actuator device 22 is instructed to repel to prevent a slamming of the vehicle door 16 to the door frame 18 (step 58). If the vehicle door 16 is not closing too rapidly then the actuator device 14 is instructed to attract thereby ensuring that the vehicle door 16 fully closes against the door frame 18 (step 60).

In one embodiment, the door sensor 22 provides information regarding the vehicle door's position and if the vehicle door 16 is already partially open, the actuator device 14 is not instructed to repel as the repelling force will not assist a user in opening the vehicle door 16. However, if the vehicle door 16 is nearly closed and a user is attempting to open the vehicle door 16, the actuator device 14 will be instructed to repel.

Activation of the actuator device 14 will depend on the proximity of the actuator device 14 to the bumper 20. If the actuator device 14 can attract or repel the bumper 20 at the pertinent door position, then the actuator device 14 will be activated. If the actuator device 14 is too far from the bumper 20 to influence the user's attempt to open or close the vehicle door 16, then the actuator device 14 will not be activated until the actuator device 14 is close enough.

FIGS. 8 and 9 illustrate another embodiment of the actuator device 14 which includes a first actuator 70 and a second actuator 72. The first actuator 70 is disposed in the door frame 18, and the second actuator 72 is disposed on the vehicle door 16 opposite the first actuator 70. The controller 24 and door sensor 22 operate in the same manner as disclosed above with respect to FIGS. 5 and 6. During closure of the vehicle door 16, the door sensor 22 provides information to the controller 24 regarding the position of the vehicle door 16 and the rate of closure. If the rate of closure is normal, that is, the rate of closure is not too fast, then the first and second actuators 70, 72 will operate to attract one another ensuring that the vehicle door 16 closes to the fully closed position. However, if the door sensor 22 provides information to the controller 24 that the vehicle door 16 is closing too rapidly, then the first and second actuators 70, 72 will operate to repel and prevent the vehicle door 16 from slamming. In addition, after the vehicle door 16 has been prevented from slamming, the first and second actuators 70, 72 may act to again attract thereby pulling the vehicle door 16 to the fully closed position. The first and second actuators 70, 72 in the illustrations of FIGS. 8 and 9 are disposed only at the top portion 36 of the vehicle door 16. However, the first and second actuators 70, 72 could be disposed at the top portion 36 of the vehicle door 16 or anywhere along the door frame 18 or door edge 19.

The above description is considered that of the illustrated embodiments only. Modifications of the invention will occur to those skilled in the art and to those who make or use the invention. Therefore, it is understood that the embodiments showing the drawings and described above are merely for illustrative purposes and not intended to limit the scope of the invention, which is defined by the following claims as interpreted according to the principles of patent law, including the Doctrine of Equivalents.

We claim:

1. A vehicle door opening device for a vehicle, comprising:
- a plurality of actuators disposed on one of a rear edge of the vehicle door and a door frame;
- a plurality of bumpers disposed on the other of the vehicle door and the door frame opposite the plurality of actuators;
- a door sensor disposed on the vehicle door that measures door position and door movement; and
- a controller that receives data from the door sensor and that instructs the plurality of actuators to repel the plurality of bumpers to force the vehicle door open from a closed position, thereby assisting a user opening the door.

2. The vehicle door opening device of claim 1, wherein:
- the plurality of actuators include an electromagnetic member that engages the plurality of bumpers.

3. The vehicle door opening device of claim 1, wherein:
- the plurality of bumpers include a rubber portion and a magnetic portion.

4. The vehicle door opening device of claim 1, wherein:
- each of the plurality of actuators includes a piezoelectric member that engages the plurality of bumpers.

5. The vehicle door opening device of claim 1, further comprising:
- a gear shift signaler connected to the controller which sends a signal to the controller indicating when the vehicle is in a parked position.

6. A vehicle door actuating device for a vehicle, comprising:
- a first plurality of opposing actuators disposed on a rear edge of a closed vehicle door and a door frame, the vehicle door including a door handle;
- a second plurality of opposing actuators disposed on a vehicle frame, wherein the first plurality of actuators are substantially aligned with the second plurality of actuators when the vehicle door is in a closed position;
- a door sensor disposed on the vehicle door that provides data relating to door position and door movement;
- a door latch coupled to the door handle; and
- a controller coupled to the first and second plurality of opposing actuators and to the door latch that instructs the first plurality of opposing actuators to repel the second plurality of opposing actuators to assist a user in opening the closed vehicle door upon actuation of the door handle by a user.

7. The vehicle door actuating device of claim 6, further comprising:
- a gear shift signaler connected to the controller which sends a signal to the controller indicating when the vehicle is in a parked position.

8. The vehicle door actuating device of claim 6, wherein:
- the first and second plurality of opposing actuators include an electromagnetic member.

9. The vehicle door actuating device of claim 6, wherein:
- the first and second plurality of opposing actuators include a piezoelectric member.

10. A method for controlling the opening and closing of a vehicle door, the method comprising:

providing an actuator on one of the vehicle door and a vehicle frame;

connecting a door sensor to the vehicle door;

measuring the position of the door relative to the vehicle frame;

measuring the velocity of the door relative to the vehicle frame; and connecting a controller to the door sensor that instructs the actuator to repel the door to assist a user in opening the door and attract the door to assist a user in closing the door from a fully closed position.

11. The method of claim 10, further comprising:

providing the actuator with an electromagnetic mechanism.

12. The method of claim 10, further comprising:

providing the actuator with a piezoelectric mechanism.

13. The method of claim 10, further comprising:

connecting a gear shift signaler with the controller which sends a signal to the controller indicating when the vehicle is in a parked position.

14. The method of claim 10, further comprising:

providing a bumper on the other of the vehicle door and the vehicle frame opposite the actuator.

15. The method of claim 14, further comprising:

forming a magnetic portion in the bumper.

16. The method of claim 10, wherein the step of providing an actuator further comprises:

installing a first electromagnetic device and a second electromagnetic device opposite the first electromagnetic device on the vehicle door and vehicle frame, respectively.

17. The method of claim 10, wherein the step of connecting a controller to the door sensor further comprises:

instructing the first actuator to repel the door when the door is closing too rapidly.

* * * * *